United States Patent [19]

Felsen

[11] 4,135,540

[45] Jan. 23, 1979

[54] MANUAL OR AUTOMATIC DRAINAGE DEVICE FOR DOWNSPOUTS

[76] Inventor: Karl H. Felsen, 47 Mattinee Bay, Winnipeg, Canada, R2G 1X9

[21] Appl. No.: 774,236

[22] Filed: Mar. 4, 1977

[30] Foreign Application Priority Data

Mar. 23, 1976 [CA] Canada ..... 248877

[51] Int. Cl.[2] ..... F16L 27/00

[52] U.S. Cl. ..... 137/78; 137/360; 137/615; 137/801; 137/875

[58] Field of Search ..... 137/78, 357, 360, 615, 137/616.7, 801, 873, 874, 875, 876; 285/184

[56] References Cited

U.S. PATENT DOCUMENTS

| | | | |
|---|---|---|---|
| 2,567,004 | 9/1951 | Benck | 137/801 X |
| 2,975,805 | 3/1961 | Horn | 137/615 |
| 3,060,952 | 10/1962 | Bystrom | 137/801 X |
| 3,316,928 | 5/1967 | Weakley | 137/615 |
| 3,375,851 | 4/1968 | Fitz Henry et al. | 137/615 X |
| 3,861,419 | 1/1975 | Johnson | 137/615 |
| 3,911,954 | 10/1975 | Johnson | 137/615 |

*Primary Examiner*—Gerald A. Michalsky
*Attorney, Agent, or Firm*—Stanley G. Ade

[57] ABSTRACT

Externally discharging downspouts normally dump water adjacent the building foundation where it accumulates and, if rainfall is heavy, it drains through the weeping tiles with the possibility of overflow inside the building leading to flooded basements. Various methods have been provided to lead downspout drainage water to a point remote from the building such as permanent pipes or automatically unrolling plastic tubes. The present device includes an adaptor secured to the downspout from which the usual elbow is removed, and a hinged trough or conduit section pivotally secured to the adaptor. The trough can be held vertically against the downspout and manually hinged downwardly when desired or can be electrically operated from one position to the other and vice-versa. If electrically operated, the operation can be automatically controlled by humidity or by switch operation from inside the building.

6 Claims, 12 Drawing Figures

MANUAL OR AUTOMATIC DRAINAGE DEVICE FOR DOWNSPOUTS

BACKGROUND OF THE INVENTION

This invention relates to new and useful improvements to downspout devices, particularly downspout devices which are adapted to discharge downspout water at a point remote from the building foundation.

Normally, a fixed length of drain pipe is secured to the lower end of the downspout so that the water discharges at a point remote from the foundation. Alternatively, a rolled plastic hose with perforations therein is secured to the bottom end of the downspout so that the water pressure in the downspout, unrolls the plastic hose once again attempting to remove the water from the base of the foundation.

Disadvantages are apparent with both of these systems. In the first instance, the pipe is permanently in the lowermost position where it may interfere with pedestrain traffic or interfere with a flower bed if one is adjacent thereto. In the second instance, the plastic hose often does not unroll and even if it does operate successfully, it has to be manually rolled to the closed position when the rain has ceased. Other methods include wooden boards in an attempt to spread the discharge of water over a larger area.

SUMMARY OF THE INVENTION

The present device overcomes all of these disadvantages by providing a discharge conduit which may be hingedly secured to an adaptor enclosure or casing which in turn is secured to the lower end of the downspout, it being understood that the usual elbow is removed from the downspout prior to the engagement of the casing or enclosure.

This conduit component which is preferably but not necessarily in the form of an open trough, may be hinged to a vertical position adjacent the downspout and detachably held in this position until it is required for the discharge of water. Under these circumstances, it may be lowered manually so that the water from the downspout is lead through the conduit or trough to a remote point and when the rain has ceased, the conduit or trough may once again be moved to the vertical stored position where it is unobtrusive and ready for immediate use when desired.

Alternatively, the raising and lowering of the conduit component or trough may be by means of an electric motor either controlled by humidity or remotely from a switch within the building against which the downspout is secured.

The humidistat controlled electric motor operated downspout trough assembly offers further advantages by its independent function. Many rain storms occur at night or at unattended times, for instance weekends or vacation periods.

The principal object and essence of the invention is therefore to provide a device of the character herewithin described which includes a conduit component or trough pivotally secured to an enclosure which in turn is secured to the lower end of a downspout so that the trough may be moved from a vertical stored position to a lowered water discharging position or vice-versa.

Another object of the invention is to provide a device of the character herewithin described in which the conduit component or trough can be actuated by means of an electrical motor which in turn may be actuated automatically by humidity or may be actuated by means of a manually operated switch.

Yet another object of the invention is to provide a device of the character herewithin described which includes a secondary discharge within the one end of the conduit component where it secures to the adaptor casing for the purpose of discharge of rain water from the downspout even when the conduit component is in the uppermost or raised position.

A still further object of the invention is to provide a device of the character herewithin described which can be manufactured from plastic, sheet metal or aluminum as desired and which furthermore is simple in construction, economical in manufacture, and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

BRIEF DESCRIPTION OF THE DRAWINGS

In the drawings like characters of reference indicate corresponding parts in the different figures.

DETAILED DESCRIPTION

Figure 1:
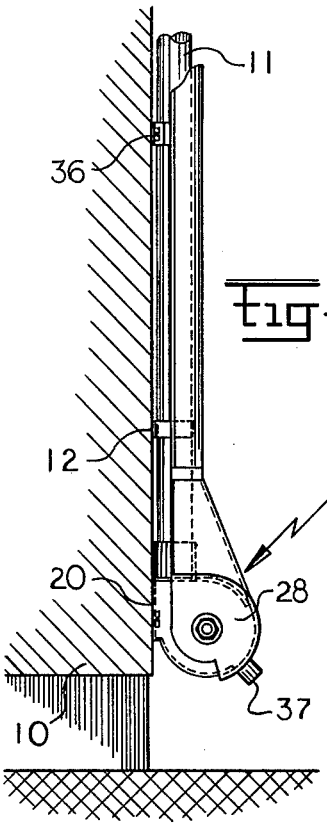
FIG. 1 is a fragmentary side elevation of one embodiment of the device showing the conduit component in the uppermost or stored position.

Proceeding therefore to describe the invention in detail, reference should first be made to the embodiment illustrated in FIGS. 1 through 5.

Reference character 10 illustrates a side of a building against which a conventional downspout 11 is secured by means of clips 12 in the usual way.

The conventional elbow bracket (not illustrated) has been removed from this downspout so that the lower end 13 is an open vertical run of the downspout 11.

The invention collectively designated 14 comprises an enclosure collectively designated 15, and a conduit component collectively designated 16.

The enclosure 15 which is preferably made of plastic, metal or aluminum, includes a pair of spaced and parallel side portions 17, a top portion 18 spanning the upper edges of the side portions 17, a base portion 19 spanning the side portions 17, said base portion, in this embodiment, curving upwardly and rearwardly to form the rear wall 20, thus enclosing the side portions 17 with the exception of an area between the front edge 21 of the upper wall 18 and the front edge 22 of the base 19, said edges in conjunction with the edges of the side portions, defining a discharge or outlet 23, to the enclosure. A relatively short cylindrical collar 24 (which also can be of any shape to suit various downspout configurations) is secured to the upper wall 18 of the enclosure and extends upwardly therefrom and communicates with the interior of the enclosure and this collar is adapted to sleeve onto the lower end 13 of the downspout 11 and to be secured to the side of the building with screws using resilient (waterproof) washers (not shown) through two mounting holes which are provided in the rear wall 20 of the enclosure and to be secured thereto by any conventional means (not illustrated).

Figure 3:
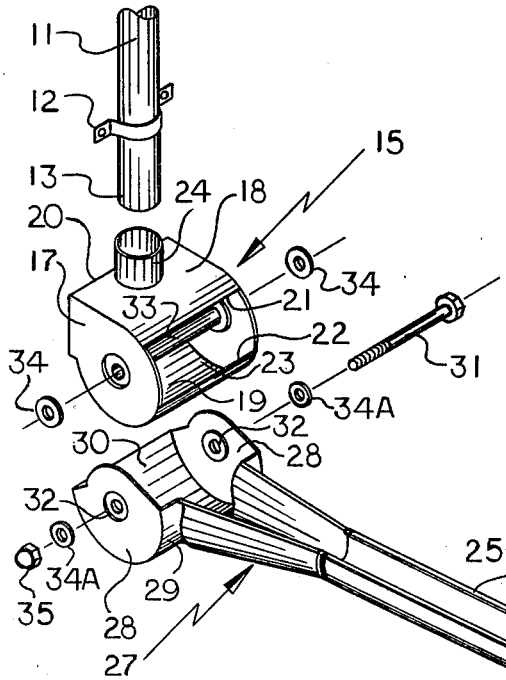
FIG. 3 is an isometric exploded view of the device shown in FIG. 2.
Figure 4:
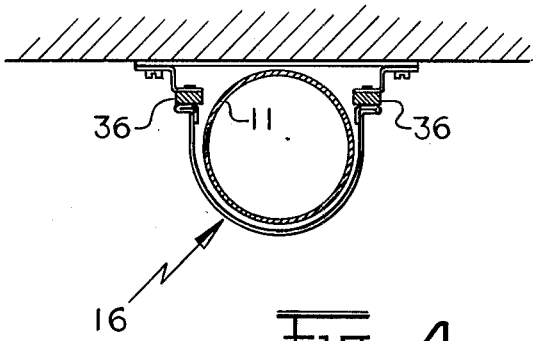
FIG. 4 is a cross sectional view of the downspout taken on a line slightly above the conduit component which is in the raised position.

The conduit component 16 may take the form of a cylindrical conduit, or preferably, an open trough form of conduit as shown in the present drawings. In FIG. 3, this trough is shown with a first section 25 and a second section 26 telescopically engageable therewith for adjustment purposes.

Figure 2:
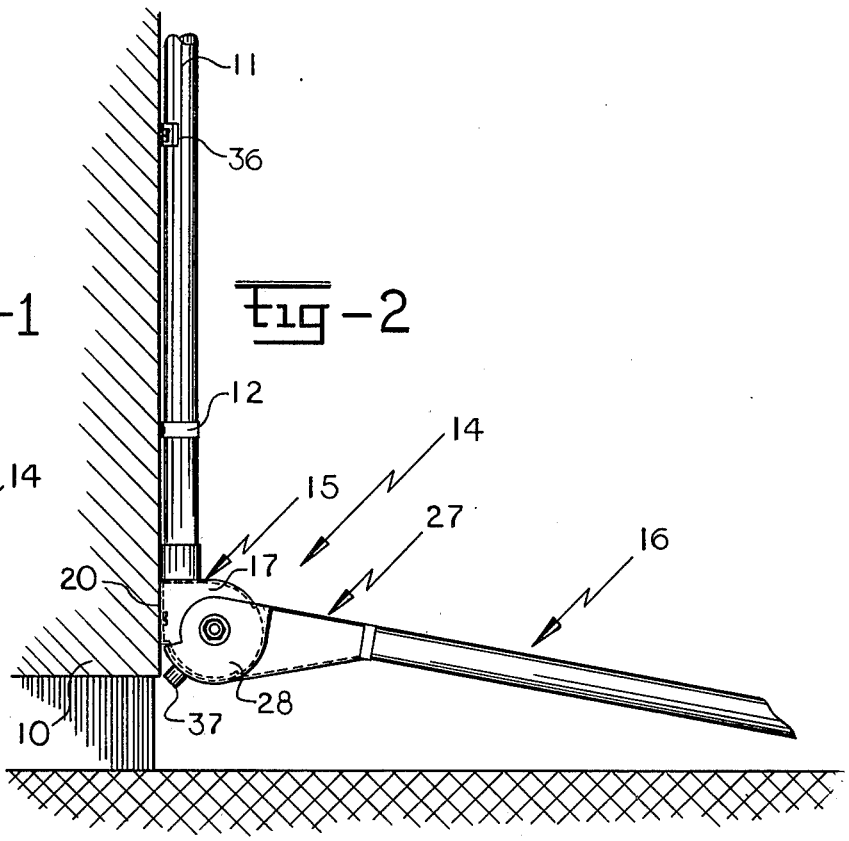
FIG. 2 is a view similar to FIG. 1, but showing the conduit component in the lowermost position.

The inner end 27 of the portion 25 includes a pair of spaced and parallel side walls or portions 28 and a curved base 29 which curves upwardly to form a rear wall portion 30 as clearly illustrated in FIG. 3. To assure smooth and quiet operation, NYLON DISK type washers 34 are placed into seating cavities on the outside of side portions 17, protruding slightly. Now the two side portions 28 engage one upon each side of the outer surface of the side portions 17 of the enclosure, with the NYLON DISK type washers 34 acting in between 17 and 28, and are pivotally secured to the enclosure by means of a pivot bolt 31 extending through apertures 32 in the side portions 28 and through a sleeve 33 spanning the side walls or portions 17 of the enclosure with the necessary washers 34A and nut 35 anchoring the bolt 31 in position so that the conduit component 16 is hingedly secured to the enclosure and may be moved from a vertical closed position as illustrated in FIG. 1, to a lowered water discharging position as shown in FIGS. 2 and 3.

The enlarged and curved shape of the adaptor enclosure and trough assembly 27 are designed to assure an equalization of water pressure and to provide a controlled discharge flow as nearby as possible.

Means are provided to detachably secure the conduit component 16 in the vertical position, which in this embodiment, take the form of magnetic attachments 36 co-operatively secured between adjacent the upper end of the conduit component 16 and the wall surface of the building.

Alternatively, magnetic tape may be applied to an appropriate location partially surrounding spout 11.

Reference to FIGS. 1 and 2 will show that a secondary discharge spout 37 is provided in the one end 27 of the component 16. It consists of a relatively small diametered collar secured to the area of the end 27 between the base 29 and the rear wall 30 and communicates with the interior of this inner end. When in the position shown in FIG. 1, this collar 37 communicates with the discharge or outlet 23 of the enclosure 15, but when in the lowered position as shown in FIG. 2, it is closed off due to the fact that the inner end of this collar is now in the proximity of the base 19 of the enclosure.

This prevents a build up of water occurring in the downspout if a light or moderate rain is encountered or if the conduit component is not lowered to the lowermost or water discharge position.

FIGS. 5 through 8 illustrate a further embodiment which is electrically operated, but the construction of the device is similar so that similar reference characters have been given.

In this embodiment, a square hole nylon bushing 38 is operatively connected to the tubular spacer or sleeve 33A, one upon each end thereof, and a square drive shaft 39 of an electric motor 40 engages through these bushings and through the spacer 33A so that if the shaft 39 rotates, then the conduit component 16 is also moved.

The electric motor includes a base plate 41 which is secured to a mounting plate 42 by means of bolts (not illustrated), the mounting plate 42 in turn being secured to a support 43 which in turn is secured to the wall surface of the building 10 or any other convenient support.

A cover 44 is detachably secured over the motor 40 and is secured in turn to the two flanges 45 on the support 43, by means of screws 46 and encloses the motor for weather protection purposes.

Figures 5, 6, 7, 8:
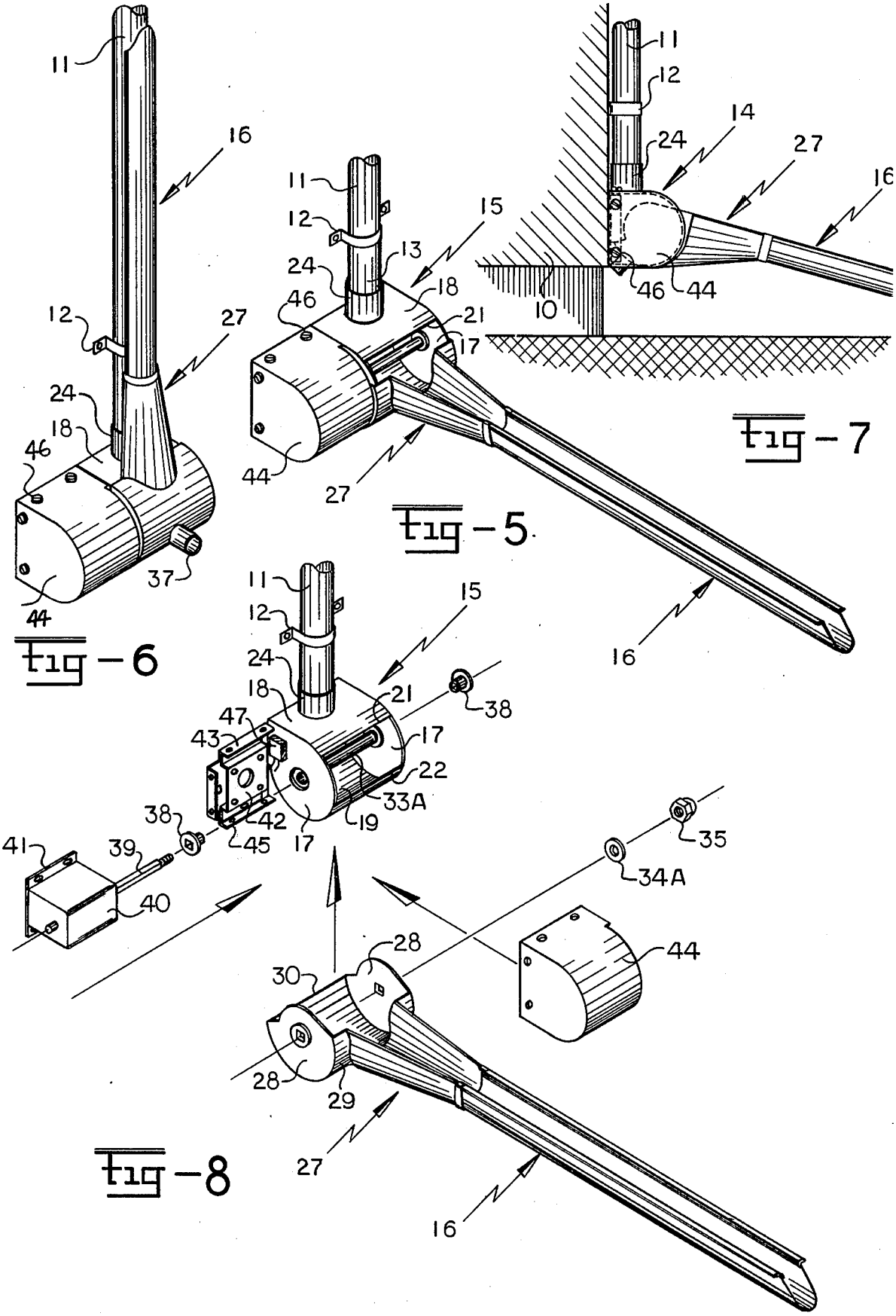
FIG. 5 is an isometric view of an alternative embodiment of the device showing the conduit component in the lowermost position.
FIG. 6 is a view similar to FIG. 5, but showing the conduit component in the raised position.
FIG. 7 is a view similar to FIG. 2, but of the embodiment illustrated in FIGS. 5 and 6.
FIG. 8 is an exploded isometric view of the embodiment illustrated in FIGS. 5, 6 and 7.
Figure 9:
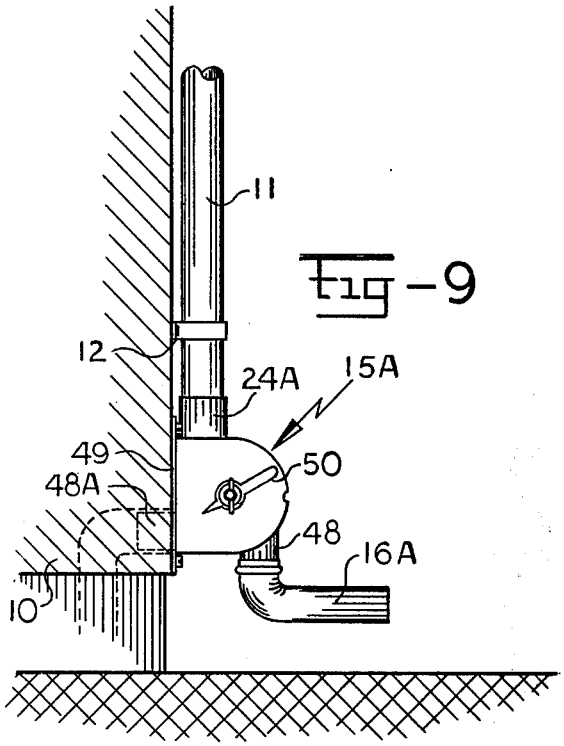
FIG. 9 is a fragmentary side elevation of a divertor component utilizing a "swivel type" discharge spout.
Figure 10:
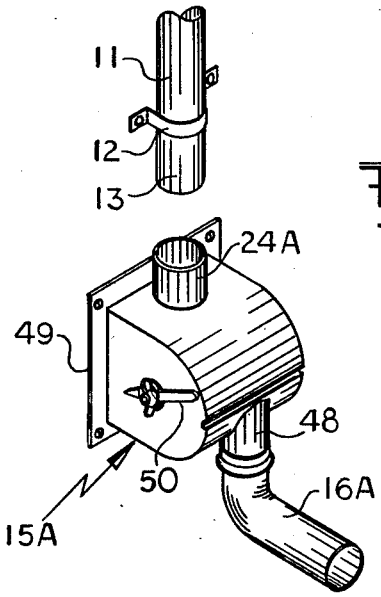
FIG. 10 is an isometric view of a divertor component utilized with a "swivel type" discharge spout.
Figure 12:
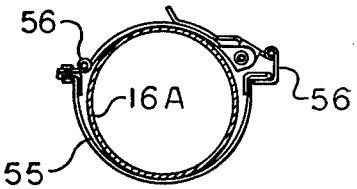
FIG. 12 is a cross sectional view of an optional trough extension with a quick release cam type latch.
Figure 11:
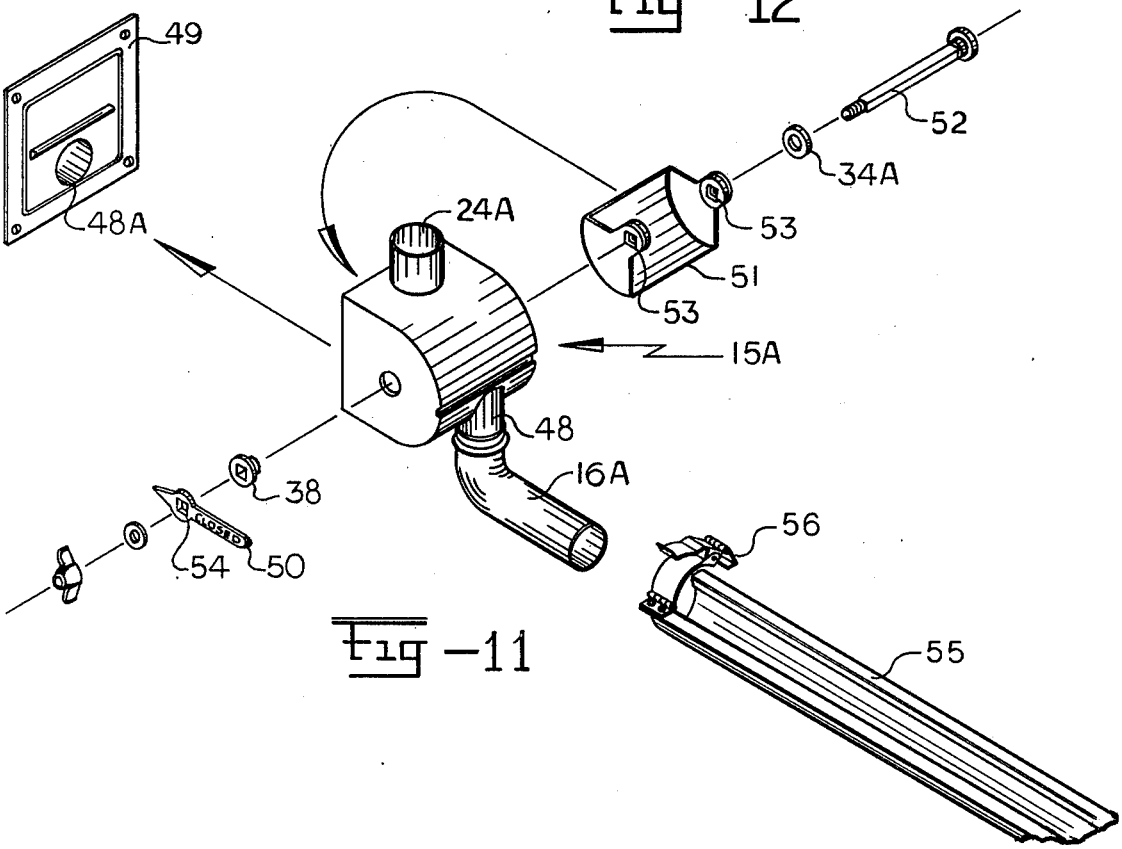
FIG. 11 is an exploded isometric view of FIGS. 9 and 10.

The motor is preferably a type of motor which can be set for approximately 95° movement of shaft 39 and which furthermore is a reversible motor so that it may move the conduit component from the position illustrated in FIG. 5 to a position illustrated in FIG. 6 or vice-versa.

The motor is connected to a source of electrical energy (not illustrated) and may be controlled by a switch within the building which is preferably a three position switch with a central neutral position.

Alternatively, a humidistat may be utilized shown schematically by reference character 47 and operatively connected to the motor so that it operates for example, when the humidity exceeds 95% thus lowering the component 16 and reversing the motor when the humidity drops below 95% thus raising the component 16.

However, any other form of humidity control operating devices can be utilized.

FIGS. 9, 10, 11 and 12 show an enclosure similar to enclosure 15 and identified by reference character 15A. It includes an inlet collar 24A and an outlet collar 48 adjacent the base of the enclosure. The rear wall 49 is provided with an internal outlet collar 48A and this may be connected to internal conduits leading to the basement drain shown in phantom in FIG. 9.

A lever 50 controls a swinging gate valve 51 journalled within the casing and movable from a position where the downspout 11 is connectable to the internal outlet collar 48A or to a position where the downspout 11 is connected to the external discharging collar 48. Nut and bolt assembly 52 includes a square shank which engages through square apertures 53 within the gate valve 51 and the handle 50 is also provided with a square aperture 54 to rotate the bolt 52 and hence the gate valve 51.

A swivel-type discharge spout 16A provides added flexibility when gate valve 51 is set to the external discharge position. This swivel-type discharge spout 16A may vary in length and becomes especially useful in tight places such as in between buildings where the direction of water discharge is of utmost importance. For further effectiveness, an optional trough extension 55 complete with a hinged "quick release" cam type latch 56, can be attached to swivel-type discharge spout 16A. This optional arrangement is clearly illustrated in FIG. 12.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. An adaptor and run-off conduit for downspouts secured to a supporting surface of a building which include an open lower end; comprising in combination an enclosure, said enclosure including an upper side, a curved base portion and a pair of spaced and parallel side portions, said enclosure having an inlet and outlet therein situated approximately 90° from one another, said inlet being defined at least in part by an edge of said base portion, said enclosure being secured by the inlet to the lower end of the associated downspout, a discharge conduit component, means to hingedly secure said conduit component at one end thereof to said enclosure whereby said conduit component is movable from a substantially vertical closed position in juxtaposition with said downspout, to a lower, water discharging position at least 90° from the vertical, means to detachably secure said conduit component to the associated downspout when in the said vertical closed position, said one end of said conduit component being operatively connected to said outlet of said enclosure, and means to secure said adaptor to the said supporting surface of the building, said discharge conduit component comprising a pair of spaced and parallel side wall plates located on opposite sides of the side portions of said enclosure and a base portion located between said side plates and shaped to conform to the curvature of said base portion of said enclosure and to register with a part of said base portion of said enclosure when said conduit component is in said closed position thereof.

2. The invention according to claim 1 in which said means to hingedly secure said conduit component to said enclosure includes a pivot bolt extending through one end of said conduit component and through said enclosure.

3. The invention according to claim 2 which includes secondary water outlet means in said one end of said conduit component operatively connected to said outlet of said enclosure when said conduit component is in the substantially vertical position and being disconnected from said outlet when said conduit component is in the lowered position.

4. The invention according to claim 1 which includes secondary water outlet means in said one end of said conduit component operatively connected to said outlet of said enclosure when said conduit component is in the substantially vertical position and being disconnected from said outlet when said conduit component is in the lowered position.

5. The invention according to claim 1 which includes an electric motor operatively connected to said conduit component to raise and lower said conduit component from said lowered position to said vertical position and vice-versa.

6. The invention according to claim 1 which includes an electric motor operatively connected to said conduit component to raise and lower said conduit component from said lowered position to said vertical position and vice-versa and humidity control means operatively connected to said motor to operate same.

* * * * *